US012606894B2

(12) United States Patent
Sun et al.

(10) Patent No.: US 12,606,894 B2
(45) Date of Patent: Apr. 21, 2026

(54) STEEL FOR GLASS LINING AND PRODUCTION METHOD THEREFOR

(71) Applicant: BAOSHAN IRON & STEEL CO., LTD., Shanghai (CN)

(72) Inventors: Quanshe Sun, Shanghai (CN); Shijie Yao, Shanghai (CN); Yan Lu, Shanghai (CN); Junkai Wang, Shanghai (CN); Qin Qin, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 691 days.

(21) Appl. No.: 17/801,641

(22) PCT Filed: Feb. 23, 2021

(86) PCT No.: PCT/CN2021/077405
§ 371 (c)(1),
(2) Date: Aug. 23, 2022

(87) PCT Pub. No.: WO2021/169937
PCT Pub. Date: Sep. 2, 2021

(65) Prior Publication Data

US 2023/0114417 A1 Apr. 13, 2023

(30) Foreign Application Priority Data

Feb. 25, 2020 (CN) ..... 202010116680.9

(51) Int. Cl.

| | |
|---|---|
| ***C22C 38/50*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/00*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C22C 38/46*** | (2006.01) |
| ***C22C 38/48*** | (2006.01) |

(52) U.S. Cl.

CPC ..... *C22C 38/50* (2013.01); *C21D 6/001* (2013.01); *C21D 6/002* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/0081* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/26* (2013.01); *C22C 38/28* (2013.01); *C22C 38/32* (2013.01); *C22C 38/42* (2013.01); *C22C 38/46* (2013.01); *C22C 38/48* (2013.01); *C21D 2211/003* (2013.01); *C21D 2211/005* (2013.01)

(58) Field of Classification Search
None
See application file for complete search history.

(56) References Cited

FOREIGN PATENT DOCUMENTS

| | | | |
|---|---|---|---|
| CN | 1966753 A | * | 5/2007 |
| CN | 102312167 A | | 1/2012 |
| CN | 102719768 A | | 10/2012 |
| CN | 102758137 A | | 10/2012 |

(Continued)

OTHER PUBLICATIONS

1st and 2nd JP Office Actions dated Sep. 26, 2023 and Mar. 26, 2024, respectively, for JP App No. 2022-551019.

(Continued)

*Primary Examiner* — Jenny R Wu

(74) *Attorney, Agent, or Firm* — Lei Fang, Esq.; Smith Tempel Blaha LLC

(57) ABSTRACT

Steel for glass lining, comprising the following chemical elements in mass percent: C: 0.015-0.060%, Si: 0.01-0.50%, Mn: 0.20-1.5%, P: 0.005-0.10%, Al: 0.010-0.070%, Ti: 0.10-0.30%, and the balance of Fe and other inevitable impurities. The microstructure of the steel for glass lining is a ferrite or a combination of a ferrite and a cementite. In addition, also disclosed is a production method for steel for glass lining, comprising the steps of (1) smelting, refining, and continuous casting to obtain a slab; (2) heating, the heating temperature being 1050-1250° C.; (3) hot rolling, the final temperature of hot rolling being controlled to be 800-920° C.; (4) cooling; and (5) thermal treatment. The steel for glass lining has excellent machinability and low temperature toughness, and also has excellent lining performance.

19 Claims, 1 Drawing Sheet

(56) References Cited

FOREIGN PATENT DOCUMENTS

| | | | | | |
|---|---|---|---|---|---|
| CN | 102766822 | A | * | 11/2012 | ..... C21D 9/46 |
| CN | 104419874 | A | | 3/2015 | |
| CN | 105331883 | A | * | 2/2016 | ..... C21D 9/46 |
| CN | 106480368 | A | | 3/2017 | |
| CN | 106811705 | A | | 6/2017 | |
| CN | 107419183 | A | | 12/2017 | |
| CN | 107663610 | A | | 2/2018 | |
| CN | 107779762 | A | * | 3/2018 | ..... C21D 8/0226 |
| CN | 107794460 | A | * | 3/2018 | ..... C21D 8/0226 |
| CN | 108796391 | A | | 11/2018 | |
| CN | 110066960 | A | * | 7/2019 | ..... C22C 38/28 |
| EP | 3358034 | A1 | | 8/2018 | |
| JP | S56169727 | A | | 12/1981 | |
| JP | S60100622 | A | | 6/1985 | |
| JP | 2018-534432 | A | | 11/2018 | |
| KR | 20040058587 | A | | 7/2004 | |
| KR | 20050068251 | A | | 7/2005 | |
| WO | 2013/099197 | A1 | | 7/2013 | |
| WO | 2013/099183 | A1 | | 4/2015 | |

OTHER PUBLICATIONS

EP Written Opinion and Supplemental EP Search Report for EP App No.

International Search Report for PCT/CN2021/077405 dated May 21, 2021.

International Written Opinion for PCT/CN2021/077405 dated May 21, 2021.

* cited by examiner

STEEL FOR GLASS LINING AND PRODUCTION METHOD THEREFOR

CROSS-REFERENCE TO RELATED APPLICATIONS

This application is a 371 U.S. National Phase of PCT International Application No. PCT/CN2021/077405 filed on Feb. 23, 2021, which claims benefit and priority to Chinese patent application No. CN202010116680.9 filed on Feb. 25, 2020, the contents of each of the above listed applications are incorporated by reference herein in their entireties.

TECHNICAL FIELD

The present disclosure relates to a metallic material and a method of manufacturing the same, particularly to a steel material and a method of manufacturing the same.

BACKGROUND ART

The glass lining process is a process in which a vitreous glaze containing a high-content quartz component is coated on the surface of a metal substrate, and then sintered at a high temperature to make the glaze firmly adhere to the surface of the substrate to form a composite material. The prior art glass-lined devices made with a steel plate as a metallic substrate, such as glass-lined reactors, glass-lined storage tanks, etc., have both the stability of glass and the high strength of metal. As a result, they have good wear resistance, extremely high corrosion resistance to various acids and organic solvents, and good corrosion resistance to alkaline solutions as well. They can be used in a wide range of applications.

In the production process of the existing glass-lined devices, after the steel plate is processed by forming, welding, etc., it has to go through repeated enameling and high-temperature firing processes. The firing temperature is about 930° C. to 870° C. Enameling defects such as fish-scaling, poor adherence and pinholes often occur during the enameling process, and these defects are also the major problems to be solved for the existing special steel plates for glass-lining. However, with an eye on the whole process from steel plate forming to enameling, further to the manufacture and service of a glass-lined device, in addition to improving the enameling performance of the steel plate, in order to improve the processing process and prolong the service cycle, it is also necessary to improve the processability of the steel plate, such as stampability, bendability, punchability, etc., and improve the low temperature toughness of the steel plate to meet the service requirements of the glass-lined device in an environment of −20° C. or less, or even −40° C.

Up to now, the steel that is commonly used in the manufacture of glass-lined devices is still the steel for making ordinary pressure containers, such as Q245R. When such steel is used for making glass-lined containers, not only enameling defects such as fish-scaling are prone to occur, but also the glass-lined devices thus made cannot meet the service requirements under −20° C. or less. On the other hand, the existing special steel for glass lining has a relatively high yield ratio (such as 0.90 or higher), and its yield strength is mostly 350 MPa or even 400 MPa or higher. Due to the high yield strength and the large fluctuation of the strength in the same steel plate and between different steel plates, forming processes such as stamping, rolling and punching are difficult. Sometimes, repeated forming is required. The poor processability is not conducive to the production of glass-lined devices. In addition, the low-temperature toughness of the glass-lined devices made from the existing special steel for glass lining is also poor, and the service requirements under the conditions at a temperature of −20° C. or lower cannot be met.

SUMMARY

One object of the present disclosure is to provide a steel for glass lining in an attempt to solve the problems of poor processability and low-temperature toughness of the existing steel for glass lining. The steel for glass lining according to the present disclosure exhibits excellent processability and low-temperature toughness, and also exhibits excellent enameling performance. It can be used effectively for making glass-lined devices.

In order to fulfill the above object, the present disclosure provides a steel for glass lining, comprising the following chemical elements in mass percentages:

C: 0.015-0.060%;
Si: 0.01-0.50%;
Mn: 0.20-1.5%;
P: 0.005-0.10%;
Al: 0.010-0.070%;
Ti: 0.10-0.30%;
a balance of Fe and other unavoidable impurities;
wherein a microstructure of the steel for glass lining is ferrite; or ferrite+cementite, preferably with a ferrite content being 90% by volume or more.

Preferably, the ferrite is comprised of uniform equiaxed grains having an average grain diameter of not greater than 40 μm.

In particular, the chemical elements in the steel for glass lining according to the present disclosure are designed according to the following principles:

C: In the steel for glass lining according to the present disclosure, carbon is an important strengthening element. As the carbon content in the steel increases, the strength increases, but the plasticity and toughness decrease. With respect to conventional steel for glass lining, the microstructure in the steel is mainly composed of pearlite+ferrite. The higher the pearlite content, the higher the strength of the steel. In the steel for glass lining according to the present disclosure, the carbon content is reduced as much as possible, so that the structure of the steel is composed of ferrite or ferrite+cementite, thereby improving the plasticity and low-temperature toughness of the steel, and improving the processability of the steel. Therefore, in the steel for glass lining according to the present disclosure, the mass percentage of C is controlled to be 0.015-0.060%.

In some preferred embodiments, the mass percentage of C may be controlled to be 0.02-0.05%.

Si: In the steel for glass lining according to the present disclosure, Si is an element for reinforcing the matrix, and also a deoxygenating element. It can improve the strength of the steel plate and the softening resistance of the steel plate during high-temperature firing. However, if the Si content is too high, while the strength is increased, the plasticity and toughness of the steel plate are degraded. It is also not conducive to welding. By balancing the improving effects and unfavorable factors of Si on the performances of the steel, the mass percentage of Si in the steel for glass lining according to the present disclosure is controlled to be 0.01-0.50%.

In some preferred embodiments, the mass percentage of Si may be controlled to be 0.10-0.40%.

Mn: In the steel for glass lining according to the present disclosure, Mn, like Si, is both an element for strengthening the matrix and a deoxygenating element. It can also improve the strength of the steel plate and the softening resistance of the steel plate during high temperature firing. In order to avoid the negative influence of excessively high strength or excessively large strength fluctuation on the processability of the steel plate, and improve the plasticity and low-temperature toughness of the steel plate, the mass percentage of Mn in the steel for glass lining according to the present disclosure is controlled to be 0.20-1.5%.

In some preferred embodiments, the mass percentage of Mn may be controlled to be 0.50-1.2%.

P: In the steel for glass lining according to the present disclosure, P is also a beneficial strengthening element. It can improve the strength of the steel plate and the softening resistance of the steel plate during high-temperature firing. However, if the phosphorus content is too high, although the strength of the steel can be improved, it will degrade the plasticity and toughness of the steel plate, which is not conducive to the later use and welding of the steel. Therefore, in order to avoid the negative influence of excessively high strength or excessively large strength fluctuation on the processability of the steel plate, and improve the plasticity and low-temperature toughness of the steel plate, the mass percentage of P in the steel for glass lining according to the present disclosure is controlled to be 0.005-0.10%.

In some preferred embodiments, the mass percentage of P may be controlled to be 0.005-0.08%. In some other embodiments, the mass percentage of P is 0.008-0.03%.

Al: In the steel for glass lining according to the present disclosure, Al is a strong deoxygenating element. It can be used to reduce the oxygen content in the steel, thereby reducing oxide inclusions in the steel and improving the plasticity and toughness of the steel. In the steel for glass lining according to the present disclosure, the mass percentage of Al is controlled to be 0.010-0.070%.

Ti: In the steel for glass lining according to the present disclosure, Ti is a strong element for forming carbides and nitrides. The addition of a sufficient amount of Ti to the steel can realize fixation of carbon and nitrogen, and combination of titanium and sulfur to form compounds. The second phase particles that can be formed eventually include TiC, TiCN, TiN, TiS and $Ti_4C_2S_2$, etc., which can exist in the form of inclusions and precipitate phases. In addition, these carbide-nitride precipitates of Ti can also prevent grain growth in the heat affected zone during welding, so that the welding performance is improved. However, if the titanium content is too high, titanium reacts preferentially with nitrogen to form coarse titanium nitride inclusions. Therefore, in the steel for glass lining according to the present disclosure, the mass percentage of Ti is controlled to be 0.10-0.30%.

Further, the steel for glass lining according to the present disclosure further comprises at least one of the following chemical elements:

Cu≤0.50%;

Cr≤0.50%;

Ni≤0.50%;

Mo≤0.50%;

wherein the following relationship is satisfied: Cu+Cr+Ni+Mo≤1.0%, wherein Cu, Cr, Ni, Mo represent their mass percentage contents.

In the steel for glass lining according to the present disclosure, appropriate amounts of copper, chromium, nickel and molybdenum can effectively reduce the bubbles generated during the enameling process of the steel plate, and improve the enamel adherence. However, excessive amounts of copper, chromium, nickel and molybdenum will not only increase the cost of the alloy, but also easily affect the enamel adherence and surface quality during the enameling process. Preferably, Cu≤0.20%, more preferably ≤0.10%; Cr≤0.20%, more preferably ≤0.10%; Ni≤0.20%, more preferably ≤0.05%; Mo≤0.10%, more preferably ≤0.05%. Preferably, when present, Cu: 0.01-0.10%; Cr: 0.01-0.10%; Ni: 0.005-0.05%; Mo: 0.005-0.03%.

In some embodiments, the steel for glass lining according to the present disclosure further comprises at least two of Cu, Cr, Ni and Mo; preferably, Cu≤0.20%, more preferably ≤0.10%; Cr≤0.20%, more preferably ≤0.10%; Ni≤0.20%, more preferably ≤0.05%; Mo≤0.10%, more preferably ≤0.05%. Preferably, when present, Cu: 0.01-0.10%; Cr: 0.01-0.10%; Ni: 0.005-0.05%; Mo: 0.005-0.03%.

Preferably, Cu+Cr+Ni+Mo≤0.5%; more preferably, Cu+Cr+Ni+Mo≤0.2%.

Further, in the steel for glass lining according to the present disclosure, the following relationship is satisfied: Ti/C≥3.0, wherein Ti and C represent the mass percentage contents of the corresponding elements respectively.

Further, in the steel for glass lining according to the present disclosure, the following relationship is satisfied: Ti/C≥4.0, wherein Ti and C represent the mass percentage contents of the corresponding elements respectively.

In the steel for glass lining according to the present disclosure, the amount of titanium added is related with carbon. By controlling the technical feature of Ti/C≥3.0, it is ensured that a pearlite structure is not formed in the steel, but a ferrite or ferrite+cementite structure is formed, thereby effectively improving the plasticity and toughness of the steel, reducing the yield strength, and improving the processability and low-temperature toughness of the steel.

Further, in the steel for glass lining according to the present disclosure, the unavoidable impurity elements include S and N, wherein: S≤0.03%; and/or N≤0.008%.

In the steel for glass lining according to the present disclosure, sulfur can combine with manganese in the steel to form manganese sulfide, a plastic inclusion, which is especially unfavorable to the transverse plasticity and toughness of the steel. Hence, the content of sulfur should be as low as possible. In the steel with titanium added, the formation of plastic inclusions of manganese sulfide can be avoided to a certain extent. Instead, composite inclusions of manganese-titanium sulfide are formed. The composite inclusions are spherical or circular in shape, and they can mitigate the damage of manganese sulfide inclusions to plasticity and toughness. These inclusions are beneficial traps for storing hydrogen, and they can improve the fish-scaling resistance of the steel plate effectively. However, if the content of sulfur is too high, the inclusion particles will be larger, and the damage to plasticity and toughness will be greater. Therefore, the content of sulfur should be controlled to be S≤0.03%. In some embodiments, the content of S is 0.001-0.03%.

In titanium-containing steel, nitrogen has an extremely high propensity to form titanium nitride inclusions. Due to the solid solubility products of nitrogen and titanium, it's likely that titanium nitride precipitates to form coarse inclusions at high temperatures or even in molten steel. These inclusions have a square or prismatic shape, and they have great damage to the plasticity and toughness of the steel. Therefore, the nitrogen content in the steel should be reduced as much as possible. It is controlled to be N≤0.008%. In some embodiments, the content of N is 0.001-0.008%.

Further preferably, in the steel for glass lining according to the present disclosure, the chemical elements also satisfy: $Ti_{eff}/C \geq 4.0$, wherein $Ti_{eff}=Ti-1.5\times S-3.43\times N$, wherein Ti, S and N represent the mass percentage contents of the corresponding elements, respectively.

As creatively discovered by the inventors through a lot of experiments, in the steel for glass lining according to the present disclosure, when $Ti_{eff}/C \geq 4.0$, the yield ratio of the steel can be reduced significantly, so that a better range of yield strength can be achieved for the steel while the tensile strength of the steel will not be reduced too much.

Further, the steel for glass lining according to the present disclosure further comprises at least one of Nb: 0.005-0.10%, V: 0.005-0.05%, and B: 0.0005-0.005%.

In the steel for glass lining according to the present disclosure, Nb and V, like titanium, are also strong elements for forming carbides and nitrides. A proper amount of niobium and/or vanadium may be added to replace titanium partly, because the higher the titanium content, the easier it is to form coarse TiN inclusions which will damage the plasticity and toughness of the steel plate. Nb and V are effective in precipitation strengthening and solid solution strengthening. Their carbide and nitride precipitate phases are also beneficial traps for irreversible storage of hydrogen to improve the fish-scaling resistance of the steel. B is very helpful to improve the fish-scaling resistance of the steel. Therefore, in the steel for glass lining according to the present disclosure, the mass percentage of Nb is controlled to be 0.005-0.10%; the mass percentage of V is controlled to be 0.005-0.05%; and the mass percentage of B is controlled to be 0.0005-0.005%.

Further preferably, in the steel for glass lining according to the present disclosure, when Nb and V elements are present, the chemical elements satisfy: $Ti+(48/93)Nb+(48/51)V \geq 4C$, wherein Ti, Nb, V and C represent the mass percentages of the respective elements.

Further, the steel for glass lining according to the present disclosure further comprises at least one of Ca: 0.001-0.005% and Mg: 0.0005-0.005%.

In the steel for glass lining according to the present disclosure, Ca and Mg mainly function to modify the characteristics of the inclusions. Due to the requirement of improving the hydrogen storing capability of the steel plate, the steel contains a number of inclusions and precipitate phases. Refined spherical inclusions are conducive to not only improving the hydrogen storing capability, but also reducing the damage to the plasticity and toughness of the steel. A minute amount of Ca or/and Mg can play a role in modifying the characteristics of the inclusions. Therefore, in the steel for glass lining according to the present disclosure, the mass percentage of Ca may be controlled to be 0.001-0.005%, and the mass percentage of Mg may be controlled to be 0.0005-0.005%.

Further, in the steel for glass lining according to the present disclosure, the contents of the chemical elements further satisfy at least one of:

C: 0.02-0.05%;

Si: 0.10-0.40%;

Mn: 0.50-1.2%;

P: 0.005-0.08%.

Further, in the steel for glass lining according to the present disclosure, the C content is 0.035-0.045%.

Further, the properties of the steel for glass lining according to the present disclosure satisfy at least one of: yield strength: 205-345 MPa; elongation: A50≥30%; Charpy impact energy at −40° C.: Akv≥34 J; and yield ratio≤0.8. Further, the properties of the steel for glass lining according to the present disclosure also include at least one of: tensile strength: 400-440 MPa; Charpy impact energy at 0° C.: Akv≥120 J; and Charpy impact energy at −20° C.: Akv≥100 J.

In a preferred embodiment, the properties of the steel for glass lining according to the present disclosure satisfy: yield strength: 205-345 MPa; elongation: A50≥30%; Charpy impact energy at −40° C.: Akv≥34 J; yield ratio≤0.8; and preferably further satisfy: tensile strength: 400-440 MPa, Charpy impact energy at 0° C.: Akv≥120 J; and Charpy impact energy at −20° C.: Akv≥100 J.

In the steel for glass lining according to the present disclosure, a preferred yield strength is 245-300 MPa; a preferred tensile strength is 405-435 MPa; a preferred A50≥35%, such as 35%-45%; a preferred yield ratio≤0.73; and a preferred Charpy impact energy at −40° C. Akv≥85 J.

Further, the thickness of the steel for glass lining according to the present disclosure is 10-25 mm.

Accordingly, another object of the present disclosure is to provide a method of manufacturing a steel for glass lining. The steel for glass lining obtained according to this manufacturing method has excellent processability and low-temperature toughness, as well as excellent enameling performance.

To fulfil the above object, the present disclosure proposes a method of manufacturing the above steel for glass lining, comprising steps:

(1) Smelting, refining, and continuous casting to obtain a slab;

(2) Heating: heating temperature: 1050-1250° C.;

(3) Hot rolling: controlling a final temperature of hot rolling at 800-920° C.; and (4) Cooling;

Further preferably, in addition to the above steps, the method of manufacturing a steel for glass lining according to the present disclosure further comprises step (5): heat treatment.

In the method of manufacturing a steel for glass lining according to the present disclosure, in the step (1), converter smelting and refining is aimed to remove harmful elements and impurity elements from the steel, and add essential alloying elements to meet the requirements of the designed target ingredients. The slab is formed by continuous casting. Compared with die casting, continuous casting can impart such characteristics as uniform composition, better surface quality, etc. Therefore, the steel plate manufactured by a continuous casting process has properties which are more consistent, more suitable for manufacturing the steel for glass lining. In the step (2), by controlling the heating temperature in the range of 1100-1250° C., the microstructure in the steel can be completely austenitized and homogenized after the slab is fully heated, such that a uniform microstructure can be obtained after rolling. The use of the above heating temperature enables partial or complete dissolution of a large amount of inclusions and precipitate phases of titanium, niobium, vanadium and the like into a solid solution state during the heating process, and they will precipitate again as small particles during a subsequent rolling and cooling process. These precipitate phases can also play a role in preventing grain growth. In the step (3), by controlling the final hot rolling temperature at 800-920° C., sufficient transformation of the ferrite structure and grain growth after rolling can be ensured, and abnormal grain growth is also prevented. The alloying elements such as titanium, niobium and vanadium in a solid solution state precipitate again as fine dispersed particles distributed on the ferrite matrix along with the progress of hot rolling deformation and the decrease of temperature. As a result, elements such as carbon and nitrogen in the steel are immobilized on the one hand, and on the other hand, refinement of the ferrite grains is also facilitated.

Further, in the method of manufacturing a steel for glass lining according to the present disclosure, in the step (4), air cooling or water cooling is utilized.

When air cooling is utilized for the cooling process, the steel plates may be cooled with air one by one, or a stack of steel plates may be cooled with air. The steel plates are finally cooled to room temperature.

When water cooling is utilized for the cooling process, the final cooling temperature of the water cooling is controlled to be 650-750° C., and the cooling rate is not greater than 50° C./s. Then, the steel plate is cooled to room temperature by air cooling.

In the technical solution of the present disclosure, the final cooling temperature of the water cooling is 650-750° C. The water cooling is performed for the purpose of accelerating the cooling, thereby effectively preventing further growth of the ferrite grains and precipitate phases. This is beneficial to improve the plasticity and toughness of the steel plate, and prevent abnormal growth of the ferrite grains. Fine precipitate phases are beneficial to improve the hydrogen storage capability of the steel plate. Accelerated cooling can also speed up the production rhythm. However, an unduly high cooling rate will result in a bad plate shape, and even cause insufficient recrystallization of ferrite and grain growth. Hence, when water cooling is utilized for the cooling process, the cooling rate is controlled to be not greater than 50° C./s.

Further, in the method of manufacturing a steel for glass lining according to the present disclosure, in the step (5), the heat treatment temperature is 880-980° C. Preferably, the hold time in the heat treatment is 30 minutes to 3 hours.

In the technical solution of the present disclosure, the original structure of the steel plate, namely the ferrite structure or the ferrite+cementite structure, is austenitized during a heating process of the heat treatment, and then transformed into ferrite during a cooling process. This can reduce the yield strength of the steel appropriately, improve the toughness of the steel, and in turn, better improve the processability and low-temperature toughness of the steel plate.

Compared with the prior art, the steel for glass lining and the method of manufacturing the same according to the present disclosure have the following advantages and beneficial effects:

Compared with the prior art, by controlling the steel composition and processing technology according to the present disclosure, the yield strength of the steel plate can be controlled steadily within an appropriate range, and the adverse influence of excessively high yield strength or its excessive fluctuation on the processability is reduced. The elongation A50≥30% of the steel for glass lining according to the present disclosure can meet the requirements for making complex molded parts. The glass-lined containers thus made meet the impact toughness requirement at temperatures of −40° C. or even lower. The steel for glass lining according to the present disclosure satisfies the yield strength of 205-345 MPa, the elongation A50≥30%, the Charpy impact energy at −40° C. Akv≥34 J, and the yield ratio≤0.8. Compared with the prior art, the steel for glass lining according to the present disclosure exhibits excellent processability and low-temperature toughness, and also exhibits excellent enameling performance. It can be used effectively for making glass-lined devices.

Figure 1:
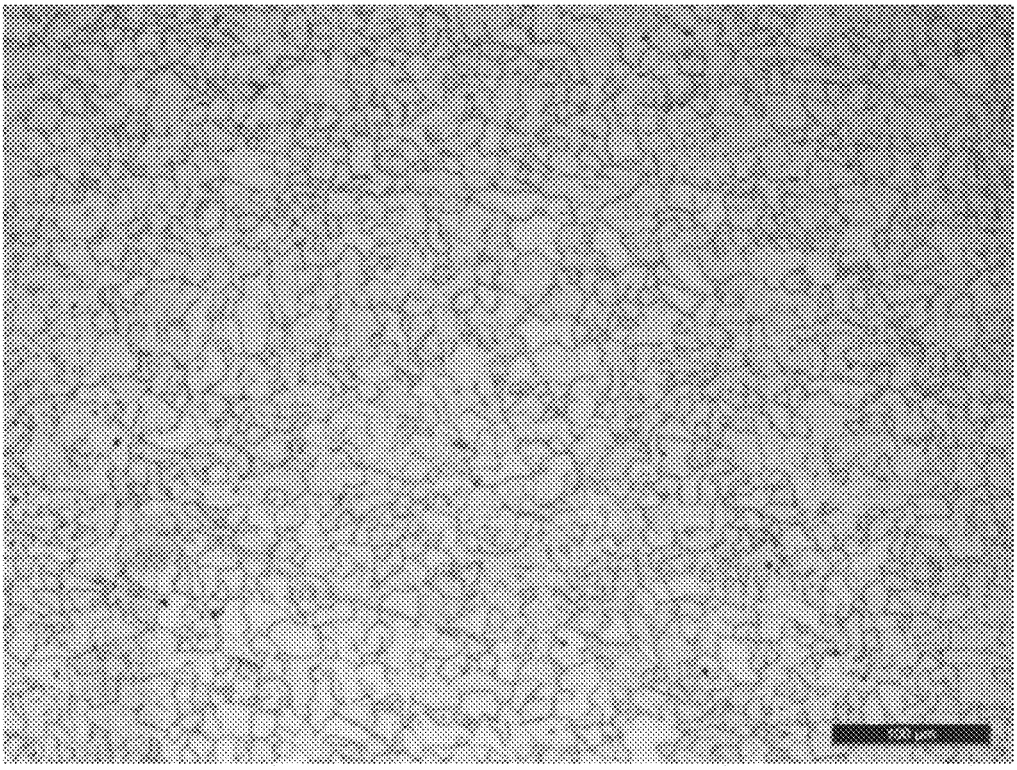
FIG. 1 shows the microstructure morphology of the steel for glass lining according to the present disclosure in a hot-rolled state in Example 2.
Figure 2:
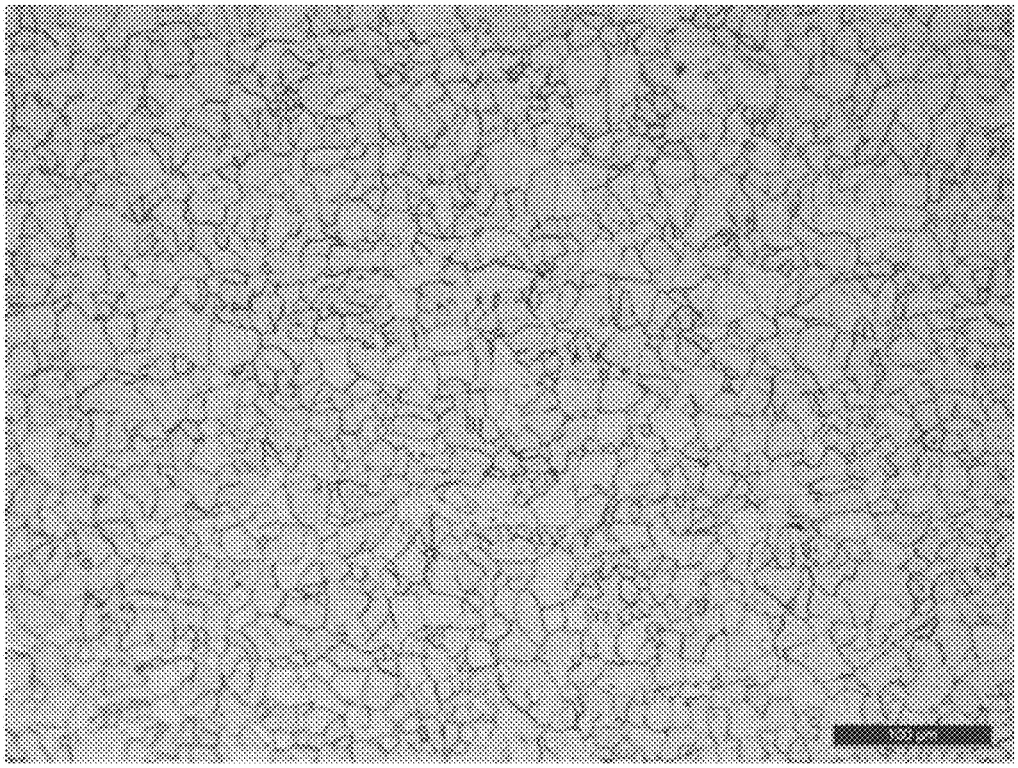
FIG. 2 shows the microstructure morphology of the steel for glass lining according to the present disclosure after the hot-rolled plate was subjected to 5 runs of simulated high-temperature firing in Example 2.

The scale in FIGS. 1 and 2 is 100 microns.

DETAILED DESCRIPTION

The steel for glass lining according to the present disclosure and the method of manufacturing the same will be further explained and illustrated with reference to the specific examples and the accompanying drawings of the specification. Nonetheless, the explanation and illustration are not intended to unduly limit the technical solution of the present disclosure.

Examples 1-6

The steel for glass lining according to the present disclosure was obtained with the following steps:

(1) Smelting, refining, and continuous casting to obtain a slab.

(2) Heating: heating temperature: 1050-1250° C.

(3) Hot rolling: controlling a final temperature of hot rolling at 800-920° C.

(4) Cooling: Air cooling or water cooling was utilized. When air cooling was utilized, the steel plate was cooled to room temperature. When water cooling was utilized, the final cooling temperature of the water cooling process was controlled at 650-750° C. The cooling rate was not greater than 50° C./s. Then, the steel plate was cooled in air to room temperature.

The method in the Examples may further comprise the step of:

(5) Heat treatment: heat treatment temperature: 880-980° C.; hold time: 30 minutes to 3 hours.

Table 1 lists the mass percentages of the various chemical elements in the steel for glass lining in Examples 1-6.

TABLE 1

| | wt % | | | | | | | | | | |
|---|---|---|---|---|---|---|---|---|---|---|---|
| | Chemical Ingredients | | | | | | | | | | |
| Ex. | C | Si | Mn | P | S | Al | N | Ti | Cu | Cr | Ni |
| 1 | 0.032 | 0.22 | 0.96 | 0.009 | 0.001 | 0.033 | 0.005 | 0.17 | 0.015 | 0.010 | — |
| 2 | 0.033 | 0.20 | 0.94 | 0.090 | 0.028 | 0.031 | 0.008 | 0.15 | 0.020 | 0.025 | — |
| 3 | 0.049 | 0.21 | 0.93 | 0.008 | 0.030 | 0.010 | 0.0055 | 0.25 | 0.055 | — | — |
| 4 | 0.034 | 0.22 | 0.20 | 0.010 | 0.001 | 0.060 | 0.003 | 0.19 | 0.010 | 0.044 | 0.012 |

TABLE 1-continued

| | | | | | | | | | | | |
|---|---|---|---|---|---|---|---|---|---|---|---|
| 5 | 0.055 | 0.015 | 0.95 | 0.010 | 0.003 | 0.024 | 0.004 | 0.18 | — | 0.050 | 0.007 |
| 6 | 0.019 | 0.35 | 1.50 | 0.030 | 0.005 | 0.035 | 0.004 | 0.10 | 0.070 | 0.020 | — |

wt %

| | Chemical Ingredients | | | | | | | | |
|---|---|---|---|---|---|---|---|---|---|
| Ex. | Mo | Nb | V | B | Ca | Mg | Ti/C | $Ti_{eff}/C$ | Cu + Cr + Ni + Mo (%) |
| 1 | 0.015 | — | — | 0.001 | — | — | 5.31 | 4.73 | 0.04 |
| 2 | — | — | — | — | — | — | 4.55 | 2.44 | 0.05 |
| 3 | 0.010 | 0.005 | 0.015 | — | — | — | 5.10 | 3.80 | 0.07 |
| 4 | — | — | 0.035 | — | — | — | 5.59 | 5.24 | 0.07 |
| 5 | — | 0.015 | 0.008 | — | 0.0015 | — | 3.27 | 2.94 | 0.06 |
| 6 | — | 0.05 | — | 0.0015 | — | 0.002 | 5.26 | 4.15 | 0.09 |

Table 2 lists the specific process parameters of the steps of the manufacturing method in Examples 1-6.

TABLE 2

| Ex. | Heating Temperature (° C.) | Finish Rolling Temperature (° C.) | Thickness (mm) | Post-rolling Cooling | Heat Treatment Temperature |
|---|---|---|---|---|---|
| 1 | 1150 | 870 | 20 | Air cooling to room temperatures | NA |
| 2 | 1100 | 820 | 20 | Air cooling to room temperatures | NA |
| 3 | 1250 | 800 | 16 | Water cooling to 650° C., average cooling rate 45° C./s | Holding at 910° C. for 1 hour |
| 4 | 1200 | 830 | 20 | Air cooling to room temperatures | NA |
| 5 | 1200 | 830 | 10 | Air cooling to room temperatures | NA |
| 6 | 1250 | 910 | 22 | Water cooling to 700° C., average cooling rate 35° C./s | Holding at 930° C. for 1 hour |

Table 3 lists the relevant process parameters of the steel for glass lining of Examples 1-6.

TABLE 3

| | Tensile Test Properties | | | | Impact Test Properties | | | |
|---|---|---|---|---|---|---|---|---|
| No. | $Rp_{0.2}$ (MPa) | $R_m$ (MPa) | A50 (%) | $R_{p0.2}/R_m$ | Akv, 0° C. (J) | Akv, −20°C. (J) | Akv, −40° C. (J) | Enameling Performance |
| Ex. 1 | 265 | 409 | 38 | 0.648 | 293 | 297 | 288 | Single-side enameling, no fish-scaling |
| Ex. 2 | 285 | 419 | 36 | 0.680 | 146 | 112 | 95 | Double-side enameling, no fish-scaling |
| Ex. 3 | 300 | 412 | 37 | 0.728 | 124 | 103 | 86 | Double-side enameling, no fish-scaling |
| Ex. 4 | 245 | 416 | 42 | 0.589 | 341 | 345 | 353 | Single-side enameling, no fish-scaling |
| Ex. 5 | 312 | 435 | 36 | 0.717 | 225 | 187 | 156 | Single-side enameling, no fish-scaling |
| Ex. 6 | 278 | 410 | 44 | 0.678 | 356 | 348 | 361 | Single-side enameling, no fish-scaling |

As it can be seen from Table 3, the steels for glass lining in Examples 1-6 exhibit excellent properties: yield strength 245-312 MPa, elongation A50≥36%, Charpy impact energy at −40° C. Akv≥86 J, and yield ratio $R_{p0.2}/R_m \leq 0.8$, indicating that the steel plates have excellent plasticity and a suitably controlled range of yield strength (that is, the yield strength fluctuates in a small range between different steel plates). When these steels for glass lining are used to make glass-lined containers, no matter in the process of stamping them into end caps or rolling them into can bodies, or in various punching processes, they not only meet the plasticity requirements of various processing and shaping processes, but also do not cause processing difficulties or significant springback due to excessively high strength or hardness of steel plates. In addition, they can reduce the number of times of stamping and rolling.

In addition, as it can be seen from the impact test toughness in Table 3, the impact energies of the steels for glass lining obtained with different compositions and processing techniques are all higher than 100 J at 0° C. and −20° C., and the impact energies at −40° C. are also higher than the standard requirement of 34 J. They fully meet the requirements of making glass-lined devices at a temperature of −20° C. or lower. They are obviously superior to the steel for glass lining used nowadays. This shows that the above steels for glass lining have excellent processability and low-temperature toughness.

Each of the above steel plates was sawed into a block sample of 150 mm×150 mm in size. Then, both sides of the sample were polished and shot blasted. The surfaces were cleaned with alcohol for enameling. A vitreous glaze (in which the quartz component was about 71% of the glaze) was used for the enameling. A single-side or double-side wet spraying process was utilized. One base glaze and two top glazes were applied. The firing temperature for the base glaze was 890-920° C., and the firing temperature for the two top glazes was 870-900° C. After the enameling was finished, the samples were let stand at room temperature for a week to observe whether there was fish-scaling on the surfaces. By utilizing the above glaze for glass lining and the above firing process, no fish-scaling was observed. Under the conditions for applying the base glaze and the top glazes, the adherence level reached Class I for all the samples. The tests show that the steel plates according to the present disclosure have good fish-scaling resistance and adherence, fully meeting the processing requirements of manufacturing glass-lined devices such as, inter alia, reactors, storage tanks.

FIG. 1 shows the microstructure morphology of the steel for glass lining according to the present disclosure in a hot-rolled state in Example 2. As it can be seen from FIG. 1, the microstructure of the steel for glass lining in this example was mainly composed of ferrite under an optical microscope when the steel was in a hot-rolled state. The grains were in a shape of uniform equiaxed grains having an average grain diameter of not greater than 40 μm. When an as-delivered steel plate has such a microstructure, the microstructure will exhibit a hereditary nature. That's to say, the fine and uniform microstructure state still remains after processing, forming and several times of high-temperature firing. Thus, the performances of the glass-lined devices in the service state are improved.

FIG. 2 shows the microstructure morphology of the steel for glass lining according to the present disclosure after the hot-rolled plate was subjected to 5 runs of simulated high-temperature firing in Example 2. The specific heat treatment process was: 900° C.×10 min+air cooling (1 time)→940° C.×10 min+air cooling (1 time)→870° C.×10 min+air cooling (3 times). As it can be seen from FIG. 2, the microstructure of the steel for glass lining in this example was still an equiaxed ferrite structure after 5 times of simulated high-temperature firing. Although the grain size was slightly larger than that in the hot-rolled state, it was still fine and uniform.

It should be noted that the examples set forth above are only specific examples according to the present disclosure. Obviously, the present disclosure is not limited to the above Examples. Similar variations or modifications made thereto can be directly derived or easily contemplated from the present disclosure by those skilled in the art. They all fall in the protection scope of the present disclosure.

What is claimed is:

1. A steel for glass lining, comprising the following chemical elements in mass percentages:

C: 0.015-0.060%;
Si: 0.01-0.50%;
Mn: 0.20-1.5%;
P: 0.005-0.10%;
Al: 0.010-0.070%;
Ti: 0.10-0.30%;
Cu≤0.50%;
Cr≤0.50%;
Ni≤0.50%;
Mo≤0.05%;
S≤0.03%;
N≤0.008%;

wherein the following relationship is satisfied: Cu+Cr+Ni+Mo≤1.0%, and $Ti_{eff}/C \geq 4.0$, wherein $Ti_{eff}=Ti-1.5\times S-3.43\times N$;

a balance of Fe and other unavoidable impurities;

wherein a microstructure of the steel for glass lining is ferrite, or ferrite+cementite;

wherein the steel has a yield strength of 205-345 MPa, and elongation A50 of ≥30%, a Charpy impact energy at −40° C. of ≥34 J, and a yield ratio of ≤0.8.

2. The steel for glass lining according to claim 1, wherein:

Cu≤0.20%;
Cr≤0.20%;
Ni≤0.20%;

wherein the following relationship is satisfied: Cu+Cr+Ni+Mo≤0.50%.

3. The steel for glass lining according to claim 1, wherein the following relationship is satisfied: Ti/C≥3.0.

4. The steel for glass lining according to claim 1, further comprising at least one of Nb: 0.005-0.10%, V: 0.005-0.05%, and B: 0.0005-0.005%.

5. The steel for glass lining according to claim 4, wherein when Nb and V elements are present, the chemical elements satisfy: Ti+(48/93)Nb+(48/51)V≥4C.

6. The steel for glass lining according to claim 1, further comprising at least one of Ca: 0.001-0.005% and Mg: 0.0005-0.005%.

7. The steel for glass lining according to claim 1, wherein the mass percentages of the chemical elements further satisfy at least one of:

C: 0.02-0.05%;
Si: 0.10-0.40%,
Mn: 0.50-1.2%;
P: 0.005-0.08%.

8. The steel for glass lining according to claim 7, wherein the mass percentage of C is 0.035-0.045%.

9. The steel for glass lining according to claim 1, wherein its properties further satisfy at least one of: tensile strength: 400-440 MPa, Charpy impact energy at 0° C.: Akv≥120 J, and Charpy impact energy at −20° C.: Akv≥100 J.

10. A method for manufacturing the steel for glass lining according to claim 1, comprising steps:

(1) Smelting, refining, and continuous casting to obtain a slab;
(2) Heating: heating temperature: 1050-1250° C.;
(3) Hot rolling: controlling a final temperature of hot rolling at 800-920° C.;
(4) Cooling; and optionally
(5) heat treatment.

11. The method according to claim 10, wherein in step (4), air cooling or water cooling is utilized for the cooling.

12. The method according to claim 11, wherein in step (4), air cooling is utilized for the cooling, wherein a single steel plate is cooled with air, or a stack of steel plates are cooled with air, finally cooling to room temperature; or water cooling is utilized for the cooling, wherein a final cooling temperature of the water cooling is 650-750° C., and a cooling rate is not greater than 50° C./s, followed by air cooling to room temperature.

13. The method according to claim 10, wherein in step (5), a temperature for the heat treatment is 880-980° C., and a hold time in the heat treatment is 30 minutes to 3 hours.

14. The steel for glass lining according to claim 1, wherein the ferrite is comprised of uniform equiaxed grains having an average grain diameter of not greater than 40 μm.

15. The steel for glass lining according to claim 3, wherein the following relationship is satisfied: Ti/C≥4.0.

16. The method according to claim 10, wherein the steel for glass lining further comprises at least one of the following elements: Cu≤0.50%, Cr≤0.50%, Ni≤0.50%, Mo≤0.50%, wherein the following relationship is satisfied: Cu+Cr+Ni+Mo≤1.0%; and/or further comprises at least one of Nb: 0.005-0.10%, V: 0.005-0.05%, and B: 0.0005-0.005%; and/or further comprises at least one of Ca: 0.001-0.005% and Mg: 0.0005-0.005%.

17. The method according to claim 10, wherein in the steel for glass lining, the following relationship is satisfied: Ti/C≥3.0, and/or the chemical elements satisfy: $T_{ieff}/C \geq 4.0$, wherein $T_{ieff}=Ti-1.5\times S-3.43\times N$.

18. The steel for glass lining according to claim 1, wherein the yield strength is 245-300 MPa; the A50 is >35%, the yield ratio is ≤0.73, and the Charpy impact energy at −40° C. is >85 J.

19. The steel for glass lining according to claim 9, wherein the tensile strength is 405-435 MPa.

* * * * *